US007069625B2

(12) United States Patent
Liu

(10) Patent No.: US 7,069,625 B2
(45) Date of Patent: Jul. 4, 2006

(54) SAFETY BUCKLE

(75) Inventor: Chun Chien Liu, Changhua Hsien (TW)

(73) Assignee: Kim Ging Hui Enterprise Co., Ltd., Changhua Hsien (TW)

( * ) Notice: Subject to any disclaimer, the term of this patent is extended or adjusted under 35 U.S.C. 154(b) by 79 days.

(21) Appl. No.: 10/995,888

(22) Filed: Nov. 22, 2004

(65) Prior Publication Data

US 2006/0107503 A1 May 25, 2006

(51) Int. Cl.
*A44B 11/25* (2006.01)
*A44B 11/26* (2006.01)

(52) U.S. Cl. ..... 24/573.09; 24/579.09; 24/614; 24/615; 24/625

(58) Field of Classification Search .. 24/573.09–574.1, 24/576.1–578.13, 578.15–581.12, 614, 615, 24/625, 662, 664
See application file for complete search history.

(56) References Cited

U.S. PATENT DOCUMENTS 494,825 A * 4/1893 Spicer ..... 24/575.1
627,300 A * 6/1899 Habicht ..... 24/616
1,599,016 A * 9/1926 Johnson et al. ..... 24/616
2,113,786 A * 4/1938 Garfinkel ..... 24/616
3,309,096 A * 3/1967 Inka ..... 24/662
3,460,282 A * 8/1969 Swirsky ..... 24/581.1
4,977,648 A * 12/1990 Eckerud ..... 24/581.1
5,659,931 A * 8/1997 Anscher ..... 24/614
5,709,014 A * 1/1998 Takahashi ..... 24/614
6,393,677 B1 * 5/2002 Anscher ..... 24/615
6,408,494 B1 * 6/2002 Anscher ..... 24/625
6,543,101 B1 * 4/2003 Sack et al. ..... 24/625
6,571,434 B1 * 6/2003 Ortiz ..... 24/615
6,711,790 B1 * 3/2004 Pontaoe ..... 24/664
6,796,007 B1 * 9/2004 Anscher ..... 24/615
6,931,695 B1 * 8/2005 Anscher ..... 24/614

* cited by examiner

*Primary Examiner*—Robert J. Sandy
*Assistant Examiner*—Ruth C. Rodriguez
(74) *Attorney, Agent, or Firm*—Pro-Techtor Int'l Services

(57) ABSTRACT

A safety buckle is disclosed to include two female buckle members respectively fastened to the two distal ends of a belt, each buckle member having a receiving open chamber and recessed engagement portions at top and bottom sides inside the receiving open chamber, and a male buckle member for joining the female buckle members, the male buckle member having two plug units for insertion into the receiving open chambers of the female buckle members respectively, each plug unit having raised engagement portions at the top and bottom sides thereof for engaging the recessed engagement portions of the respective female buckle member.

2 Claims, 4 Drawing Sheets

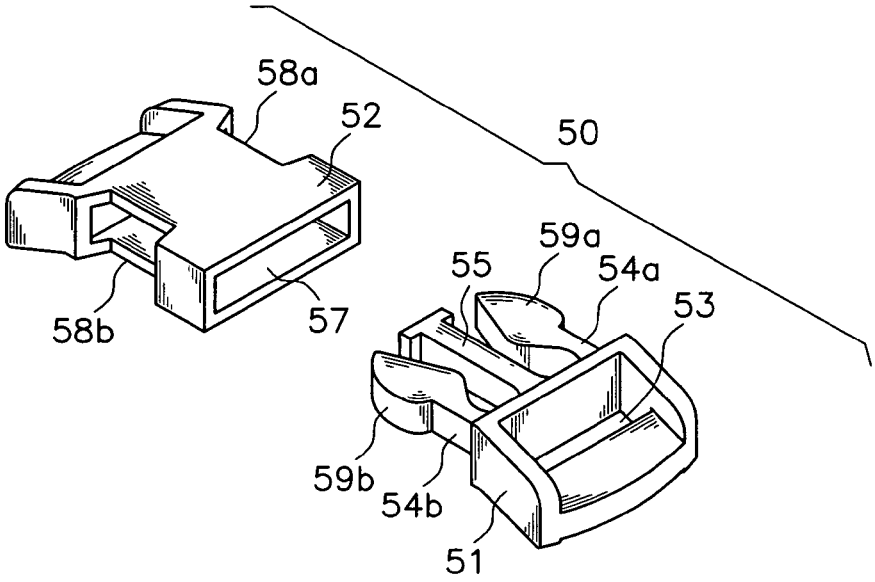
*FIG. 1* *(Prior Art)*
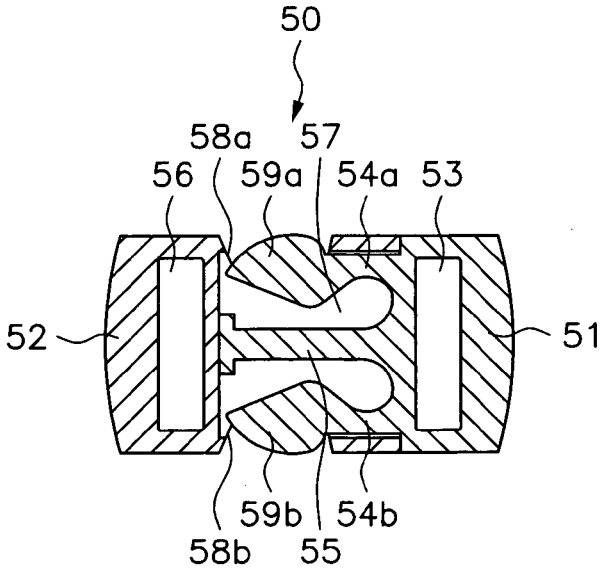
*FIG. 2* *(Prior Art)*

SAFETY BUCKLE

BACKGROUND OF THE INVENTION

1. Field of the Invention

The present invention relates to buckle and more particularly, to a safety buckle, which is automatically unlocked when stretched by a force over a predetermined level.

2. Description of the Related Art

For fastening purpose, woven belts are intensively used in different products including collar and harness for pet, baby cradle, backpack, safety helmet, slipper, safety jacket, cargo and passenger safety belts, etc. For a wide range of application to different products, a belt must be used with a buckle.

For example, a collar for cat is usually used with a safety buckle so that the collar can automatically be unfastened if the collar is detained by an object during jumping of the cat, preventing a hurt to the cat. In other words, the safety buckle is automatically unlocked to unfasten the collar from the cat for letting the cat go freely without hurt when the collar received a stretching force over the limited range (normally about 10 lbs or 5 kgs). A collar for cat is normally used for holding a nameplate, bell, or any of a variety of ornamental devices.

FIG. 1 shows a prior art design safety buckle. Similar to conventional side release buckles, the safety buckle 50 is comprised of a male buckle member 51 and a female buckle member 52. The male buckle member 51 comprises an insertion slot 53 transversely provided at the rear side for the mounting of a belt, a center shaft 55 forwardly extended from the front side thereof on the middle, and two locking bars 54*a* and 54*b* forwardly extended from the front side and equally spaced from the center shaft 55 at two sides. The locking bars 54*a* and 54*b* each have a front end terminating at a hooked portion 59*a* or 59*b*. The female buckle member 52 comprises a receiving open chamber 57 adapted to receive the center shaft 55 and locking bars 54*a* and 54*b* of the male buckle member 51, and two side retaining holes 58*a* and 58*b* symmetrically disposed at two opposite lateral sides for receiving the hooked portions 59*a* and 59*b* of the locking bars 54*a* and 54*b*. As illustrated in FIG. 2, when squeezing the two locking bars 54*a* and 54*b* inwards toward the inside of the female buckle member 52, the hooked portions 59*a* and 59*b* of the locking bars 54*a* and 54*b* are respectively disengaged from the retaining holes 58*a* and 58*b* of the female buckle member 52, and therefore the male buckle member 51 is released from the female buckle member 52. To be different from conventional side release buckles, the hooked portions 59*a* and 59*b* of the locking bars 54*a* and 54*b* of the female buckle member 51 of the safety buckle 50 have a smoothly arched outer surface so that the male buckle member 51 can quickly be disconnected from the female buckle member 52 when the belt (collar) connecting between the male buckle member 51 and the female buckle member 52 is stretched by a force surpassed a predetermined range. Conventional side release buckles are designed to bear a relatively higher stretching force.

Because the aforesaid safety buckle is similar to conventional side release buckles in shape and structure, it does not attract consumers to use.

SUMMARY OF THE INVENTION

The present invention has been accomplished under the circumstances in view.

It is one object of the present invention to provide a safety belt, which has an innovative structure and outer appearance that attracts consumers' eyes.

It is another object of the present invention to provide a safety buckle, which has multiple locking points that bear external stretching force evenly.

To achieve these and other objects and according to one aspect of the present invention, the safety buckle comprises a first female buckle member and a second female buckle member respectively fastened to the two distal ends of a belt, and a male buckle member for joining the female buckle members. Each female buckle member comprises a receiving open chamber and two pairs of recessed engagement portions at the top and bottom sides inside the receiving open chamber. The male buckle member comprises two plug units for insertion into the receiving open chambers of the female buckle members respectively. Each plug unit comprises two pairs of raised engagement portions at the top and bottom sides for engaging the recessed engagement portions of the respective female buckle member.

According to another aspect of the present invention, the recessed engagement portions of the first female buckle member and the recessed engagement portions of the second female buckle member have the same shape and size. Further, the raised engagement portions of the first plug unit fit the recessed engagement portions of the two female buckle members in size and shape and are relatively greater in size than the raised engagement portions of the second plug unit.

BRIEF DESCRIPTION OF THE DRAWINGS

FIG. 1 is an exploded view of a safety buckle according to the prior art.

FIG. 2 is a sectional view of the prior art safety buckle, showing the male buckle member and the female buckle member fastened together.

DETAILED DESCRIPTION OF THE PREFERRED EMBODIMENT

Figure 3:
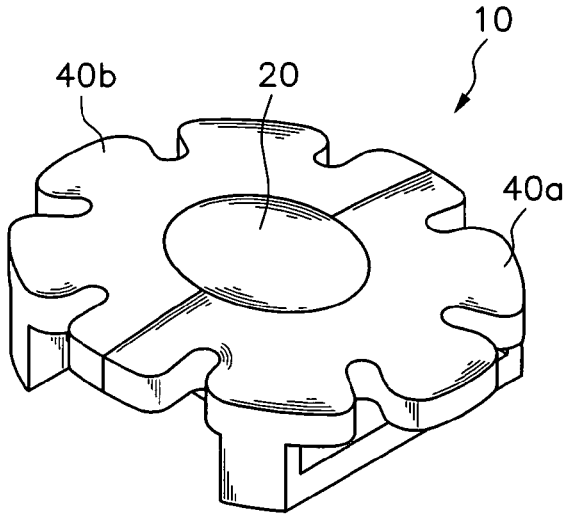
FIG. 3 is an elevational view of a safety buckle according to the present invention.
Figure 4:
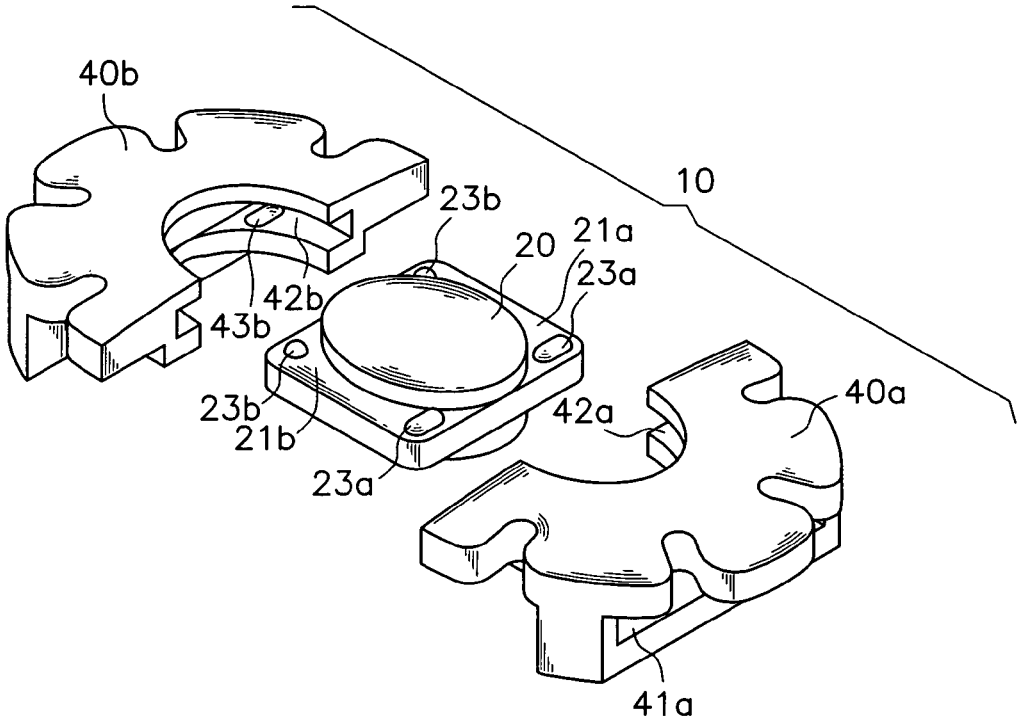
FIG. 4 is an exploded view of the safety buckle according to the present invention.
Figure 5:
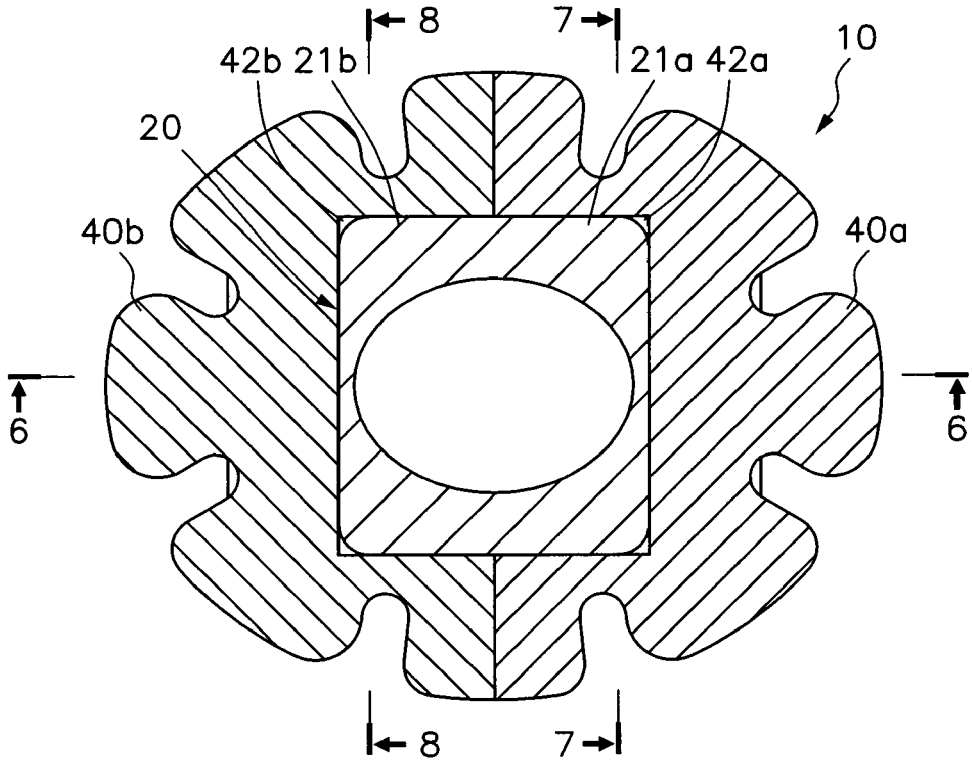
FIG. 5 is a cross-sectional view of FIG. 3.
Figure 6:
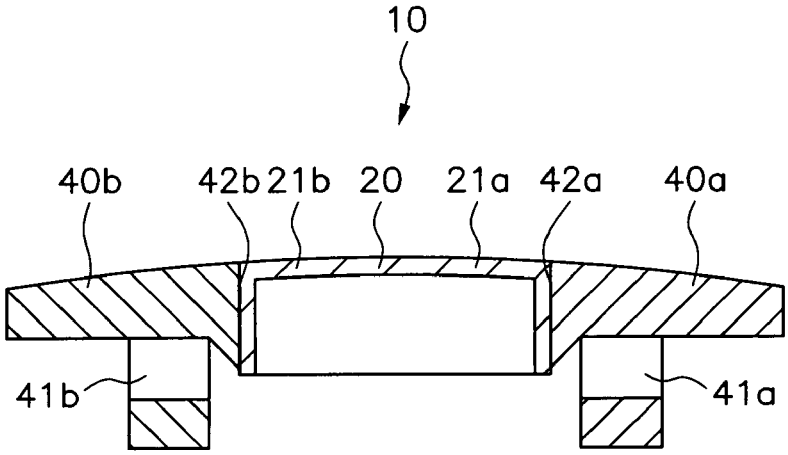
FIG. 6 is a sectional view taken along line 6—6 of FIG. 5.

Referring to FIGS. 3~4, a safety buckle 10 is shown comprised of a male buckle member 20, a first female buckle member 40*a*, and a second female buckle member 40*b*. The male buckle member 20 comprises a first plug unit 21*a* and a second plug unit 21*b* symmetrically provided at two sides and respectively inserted into the first female buckle member 40*a* and the second female buckle member 40*b* (see FIG. 5). The first plug unit 21*a* has two pairs of raised engagement portions 23*a* respectively symmetrically provided at the top and bottom sides thereof. The second plug unit 21*b* has two pairs of raised engagement portions 23*b* respectively symmetrically provided at the top and bottom sides thereof.

Figure 7:
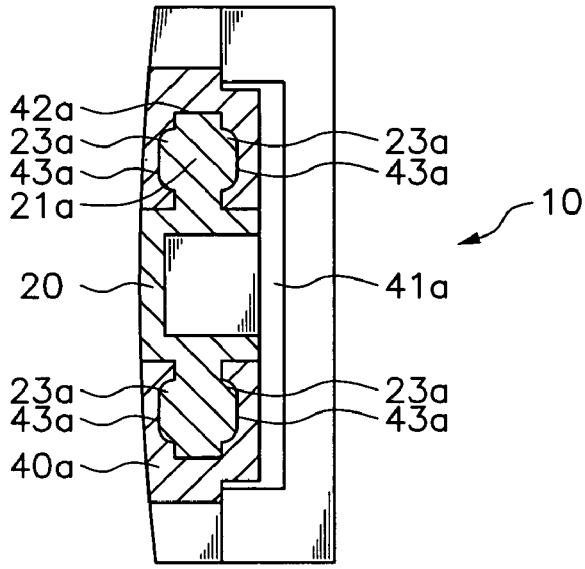
FIG. 7 is a sectional view taken along line 7—7 of FIG. 5.

The first female buckle member 40*a* has a bottom insertion slot 41*a* for the insertion (mounting) of the first end of a belt (not shown), a receiving open chamber 42*a* for receiving the first plug unit 21*a* of the male buckle member 20, and two pairs of recessed engagement portions 43*a* respectively symmetrically provided at the top and bottom walls inside the receiving open chamber 42*a* for receiving the raised engagement portions 23*a* of the first plug unit 21*a* to secure the male buckle member 20 to the first female buckle member 40*a* upon insertion of the first plug unit 21*a* of the male buckle member 20 into the receiving open chamber 42*a* (see FIG. 7).

Figure 8:
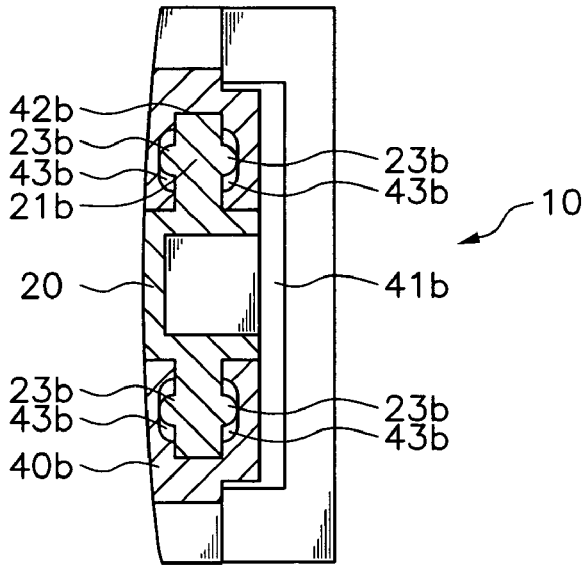
FIG. 8 is a sectional view taken along line 8—8 of FIG. 5.

The second female buckle member 40*b* has a bottom insertion slot 41*b* for the insertion (mounting) of the second end of the belt being fastened to the first female buckle member 40*a*, a receiving open chamber 42*b* for receiving the second plug unit 21*b* of the male buckle member 20, and two pairs of recessed engagement portions 43*b* respectively symmetrically provided at the top and bottom walls inside the receiving open chamber 42*b* for receiving the raised engagement portions 23*b* of the second plug unit 21*b* to secure the male buckle member 20 to the second female buckle member 40*b* upon insertion of the second plug unit 21*b* of the male buckle member 20 into the receiving open chamber 42*b* (see FIG. 8).

By means of the engagement between the four raised engagement portions 23*a* and 23*b* of the plug units 21*a* and 21*b* of the male plug member 20 and the recessed engagement portions 43*a* and 43*b* of the first and second female buckle members 40*a* and 40*b* to form four locking points in four corners (one raised engagement portion and one recessed engagement portion form one locking point), the safety buckle 10 is positively locked, and any stretching force applied to the belt can evenly be distributed to the four locking points, i.e., the four locking points equally bear any stretching force applied to the belt, preventing damage to the safety buckle.

Another feature of the present invention is that the raised engagement portions 23*a* of the first plug unit 21*a* are greater than the raised engagement portions 23*b* of the second plug unit 21*b*, however the recessed engagement portions 43*a* of the first female buckle member 40*a* and the recessed engagement portions 43*b* of the second female buckle member 40*b* are equal in size and fit the size of the raised engagement portions 23*a* of the first plug unit 21*a*. Therefore, when inserted the first plug unit 21*a* into the first female buckle member 40*a*, the raised engagement portions 23*a* of the first plug unit 21*a* fully fill up the respective recessed engagement portions 43*a* of the first female buckle member 40*a*. However, when inserted the second plug unit 21*b* into the second female buckle member 40*b*, the raised engagement portions 23*b* of the second plug unit 21*b* do not fully fill up the respective recessed engagement portions 43*b* of the first female buckle member 40*b*. The feature enables the second female buckle member 40*b* to be separated from the second plug unit 21*b* with the safety buckle 10 retained to the belt when the safety buckle 10 received a stretching force from the belt over a predetermined level, i.e., the second female buckle member 40*b* is retained to the second end of the belt and the first female buckle member 40*a* with the male buckle member 20 are kept secured to the first end of the belt. This design prevents disconnection of the first female buckle member 40*a* and the second female buckle member 40*b* from the male buckle member 20 at the same time.

Actually, the first female buckle member 40*a* and the second female buckle member 40*b* have the same shape and size, and are interexchangeable for receiving the first plug unit 21*a* or second plug unit 21*b* of the male buckle member 20.

As indicated above, the safety buckle is automatically unlocked when received a stretching force over a predetermined level. Therefore, the safety buckle of the present invention is practical for use with a collar for cat or product that needs to be automatically unlocked. When the user wishes to unlock the safety buckle after the safety buckle has been fastened with a belt (collar) to a cat, the user can hold the male buckle member 20 with one hand and the stretch the belt with the other hand to disengage the first female buckle member 40*a* or second female buckle member 40*b* from the male buckle member 20, so as to unfasten the belt (collar) from the cat.

Although a particular embodiment of the invention has been described in detail for purposes of illustration, various modifications and enhancements may be made without departing from the spirit and scope of the invention.

The invention claimed is:

1. A safety buckle comprising:

a male buckle member, said male buckle member comprising a first plug unit and a second plug unit symmetrically provided at two sides, said first plug unit having two pairs of raised engagement portions respectively symmetrically provided at top and bottom sides thereof, said second plug unit having two pairs of raised engagement portions respectively symmetrically provided at top and bottom sides thereof;

a first female buckle member connectable to said first plug unit, said first female buckle member comprising an insertion slot for the mounting of a belt, a receiving open chamber for receiving said first plug unit of said male buckle member, and two pairs of recessed engagement portions respectively symmetrically provided at top and bottom walls inside the receiving open chamber of said first female buckle member for receiving the raised engagement portions of said first plug unit to secure said male buckle member to said first female buckle member upon insertion of said first plug unit of said male buckle member into the receiving open chamber of said first female buckle member; and a second female buckle member connectable to said second plug unit, said second female buckle member comprising an insertion slot for the mounting of a belt, a receiving open chamber for receiving said second plug unit of said male buckle member, and two pairs of recessed engagement portions respectively symmetrically provided at top and bottom walls inside the receiving open chamber of said second female buckle member for receiving the raised engagement portions of said second plug unit to secure said male buckle member to said second female buckle member upon insertion of said second plug unit of said male buckle member into the receiving open chamber of said second female buckle member.

2. The safety buckle as claimed in claim 1, wherein the recessed engagement portions of said first female buckle member and the recessed engagement portions of said second female buckle member have the same shape and size; the raised engagement portions of said first plug unit fit the recessed engagement portions of said first female buckle member and the recessed engagement portions of said second female buckle member in size and shape, and are relatively greater in size than the raised engagement portions of said second plug unit.

* * * * *